US006676577B2

(12) United States Patent
Stearns

(10) Patent No.: US 6,676,577 B2
(45) Date of Patent: Jan. 13, 2004

(54) APPARATUS FOR ISOLATED, CLOSED CHAIN EXERCISE OF A PERSON'S QUADRICEPS MUSCLES

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 113 days.

(21) Appl. No.: 09/917,007

(22) Filed: Jul. 27, 2001

(65) Prior Publication Data

US 2003/0022772 A1 Jan. 30, 2003

(51) Int. Cl.[7] ..... A63B 26/00

(52) U.S. Cl. ..... 482/142; 482/62; 482/92; 482/148; 482/93; 482/907

(58) Field of Search ..... 482/79, 92–96, 482/100, 131, 135, 139, 142, 148, 906–907

(56) References Cited

U.S. PATENT DOCUMENTS 5,554,090 A * 9/1996 Jones ..... 482/97
5,827,154 A * 10/1998 Gill ..... 482/9

* cited by examiner

*Primary Examiner*—Nicholas D. Lucchesi
*Assistant Examiner*—L. Amerson

(57) ABSTRACT

An exercise machine includes a frame designed to rest upon a floor surface; a back rest mounted on the frame; and a foot platform mounted on the frame. At least one of the foot platform and the back rest is pivotally mounted on the frame in such a manner that a person may rest his back against the back rest and exercise his quadriceps muscles in isolated, closed chain fashion. A resistance device is preferably provided to resist movement of the back rest and/or the foot platform in a manner that opposes the user's efforts to straighten his legs at the knees.

17 Claims, 9 Drawing Sheets

APPARATUS FOR ISOLATED, CLOSED CHAIN EXERCISE OF A PERSON'S QUADRICEPS MUSCLES

FIELD OF THE INVENTION

The present invention relates to methods and apparatus for exercising a person's quadriceps muscles in isolated, closed chain fashion.

BACKGROUND OF THE INVENTION

The quadriceps muscles constitute one of the human body's major muscle groups, and these muscles are primarily responsible for moving a person's legs from a bent knee position to a straight leg position. Exercise machines have been built for the specific purpose of resisting this particular motion and thereby strengthening and/or toning a person's quadriceps muscles.

A conventional quadriceps exercise machine, known in the fitness industry as a leg extension machine, is shown in FIGS. 6–7. This prior art leg extension machine 90 generally includes a frame 91, a seat 92 rigidly mounted on the frame 91, a pivot arm 93 pivotally mounted on the frame 91, and a weight stack resistance device 97 mounted on the frame 91 and operatively connected to the pivot arm 93. The resistance device 97 includes a variable amount of weight 98 that is connected to the pivot arm 93 by means of a cable 99. The components of the machine 90 are preferably arranged so that a user's knee is axially aligned with the pivot axis of the pivot arm 93, and a pad 94 on the pivot arm 93 bears against the user's shin. Counter-clockwise rotation of the pad 94, caused by straightening of the user's leg at the knee (but not the hip), is resisted by gravity acting upon the weight 98.

The leg extension machine 90 has been a staple item in fitness clubs for decades. Typically, it is provided as part of a circuit of a dozen or so machines, each of which is dedicated to a single exercise and/or a particular muscle group. As noted above, the leg extension machine 90 is provided for isolated exercise of a person's quadriceps muscles. Generally speaking, the theory behind these circuits is that each machine allows a person to focus on a specific muscle group or exercise movement, and several people can use alternative, high quality machines in parallel. In another familiar arrangement that is also suitable for circuit training, a similar leg extension assembly is mounted on a relatively larger frame that also supports other types of exercise mechanisms (sometimes referred to as universal gyms).

Unfortunately, recent medical opinions are suggesting that conventional leg extension machines (or assemblies) may cause pain and/or damage to a person's knees. One possible explanation is that the conventional leg extension machine involves an "open chain" arrangement, wherein the person's leg is loaded in cantilevered fashion. Generally speaking, this sort of exercise tends to impose significant shearing force on a person's joint (in this case, the knee). On the other hand, a "closed chain" exercise involves stabilization of the distal ends of any limbs being exercised, thereby encouraging joint stability and coordinated interaction of the associated body components.

One type of conventional "closed chain" exercise machine, known in the fitness industry as a leg press machine, is shown in FIGS. 8–9. Like the leg extension machine 90, this prior art leg press machine 80 has also been a staple item in fitness clubs for decades, and is similarly provided as part of a circuit of machines and on universal gym units. The leg press machine 80 generally includes a frame 81, a seat 82 slidably mounted on the frame 81, a foot platform 83 mounted on the frame 81 in front of the seat 82, and a weight stack resistance device 87 mounted on the frame 81 and operatively connected to the seat 82. The resistance device 87 includes a variable amount of weight 88 that is connected to the seat 82 by means of a cable 89. Movement of the seat 82 away from the foot platform 83, caused by extension of the user's legs at both the hip joints and the knee joints, is resisted by gravity acting upon the weight 88. Another common type of leg press machine (not shown) has a fixed seat and a pivoting foot support that cooperate to facilitate a similar exercise motion. In other words, movement of the pedals away from the seat is similarly caused by extension of the user's leg at both knees and hips.

Although conventional leg press machines facilitate closed chain exercise of a person's quadriceps muscles, a significant amount of the user exerted force is generated by a person's gluteus muscles (due to extension of the user's legs at the hips, as well as the knees). As a result, conventional leg press machines are ineffective for isolated exercise of a person's quadriceps muscles. In other words, a need exists for an exercise apparatus that facilitates isolated, closed chain exercise of a person's quadriceps muscles.

SUMMARY OF THE INVENTION

The present invention provides methods and apparatus for exercising a person's quadriceps muscles in isolated, closed chain fashion. The present invention may be implemented in various ways and/or described with reference to various embodiments and methods. A preferred embodiment includes a frame that is designed to rest on a floor surface; a body support, having at least a back rest, that is movably mounted on the frame; and a foot platform that is mounted on the frame in front of the body support. The body support and the foot platform are configured and arranged to support a person in a rest position with his back against the back rest, his thighs extending generally perpendicular to his torso, his legs bent at the knees, and his feet flat against the foot platform. As the person straightens his legs at the knees, the body support and the foot platform cooperate to maintain a fixed, perpendicular angle between the user's thighs and torso, thereby isolating the user's quadriceps muscles, while continuously supporting the user's legs in closed chain fashion. Among other things, the body support may be selectively latched to the frame or limited to a desired range or rotation, in order to reduce the likelihood of injury during exercise and/or to facilitate mounting and dismounting of the apparatus. Also, the foot platform may be adjusted relative to the frame to accommodate persons of various sizes and/or different ranges of exercise motion. Additional aspects and/or optional features of the present invention will become apparent from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of a preferred embodiment exercise machine constructed according to the principles of the present invention;

Figure 5A:
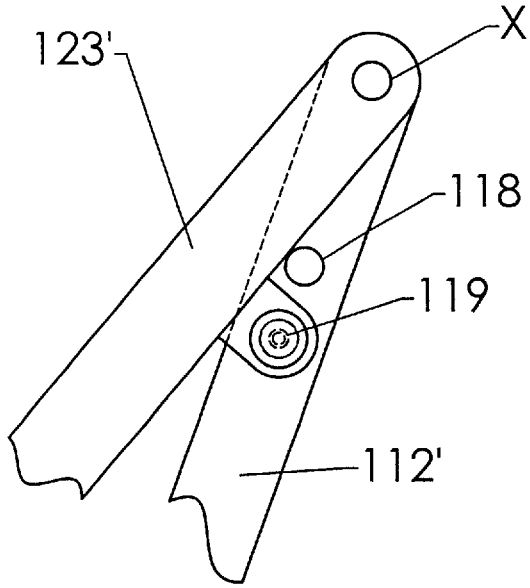
Figure 5B:
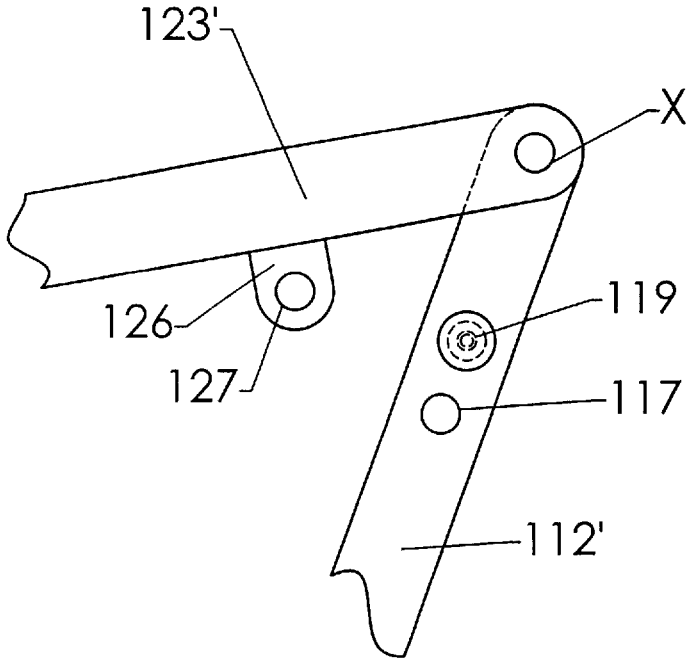
Figure 6:
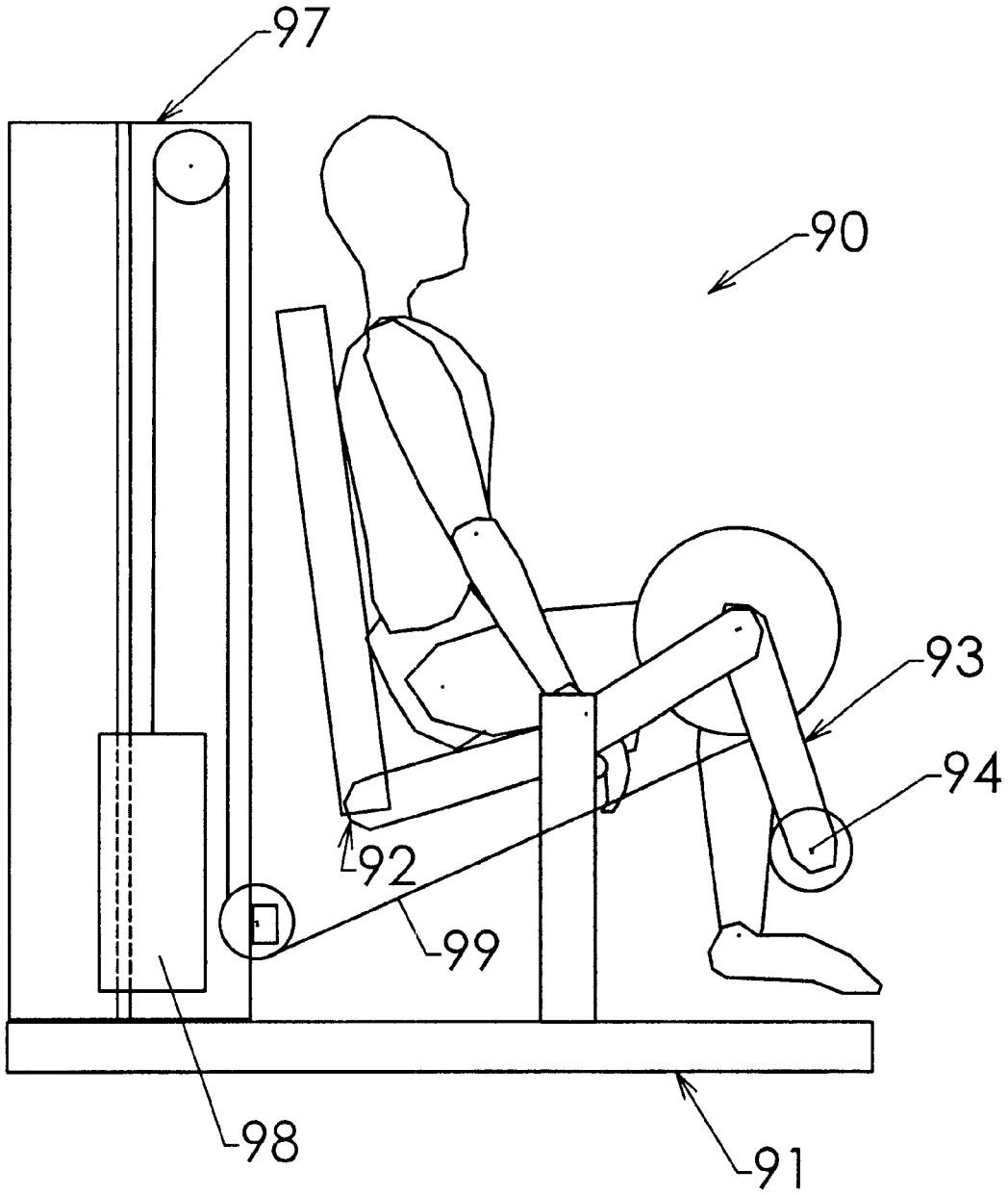
Fig. 6 (prior art)
Figure 7:
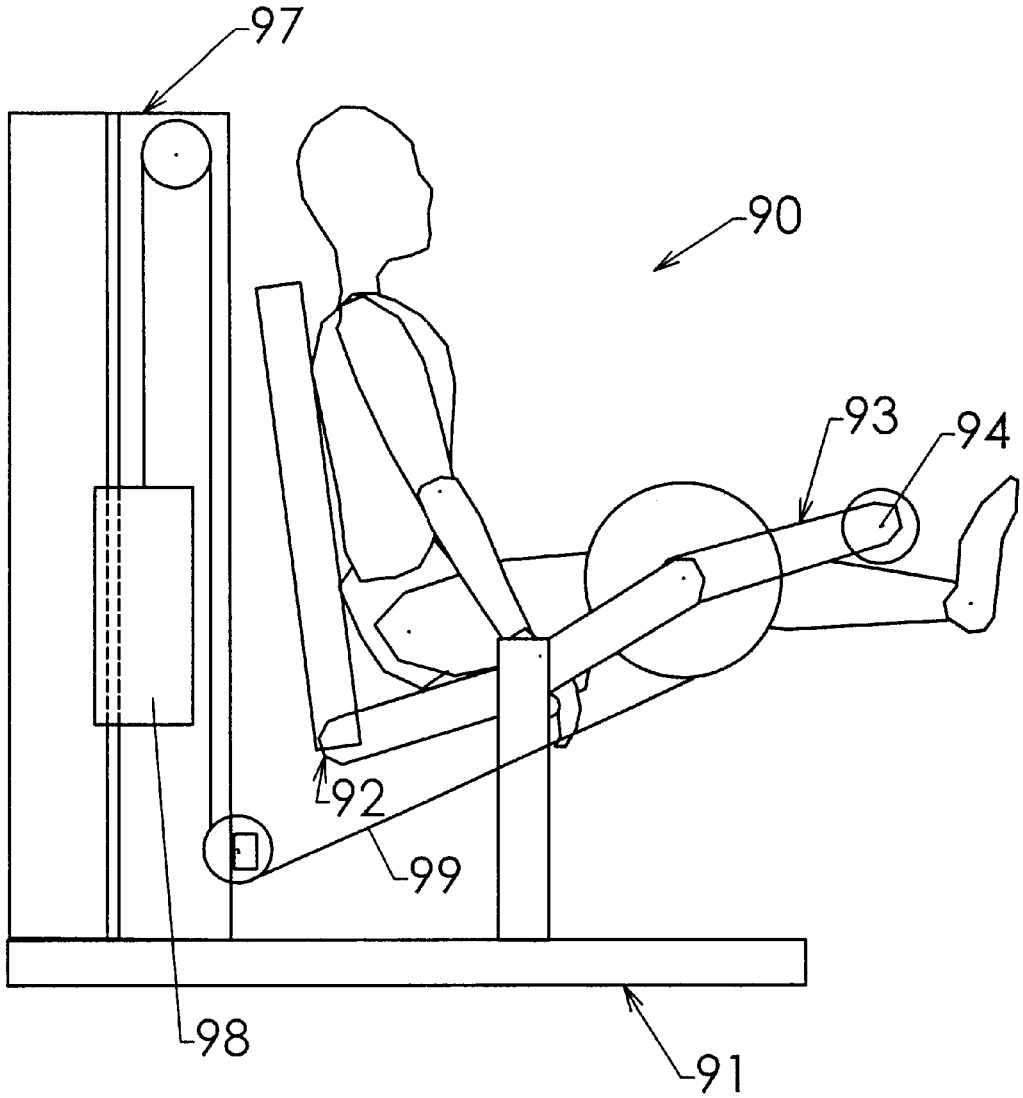
Fig. 7 (prior art)
Figure 8:
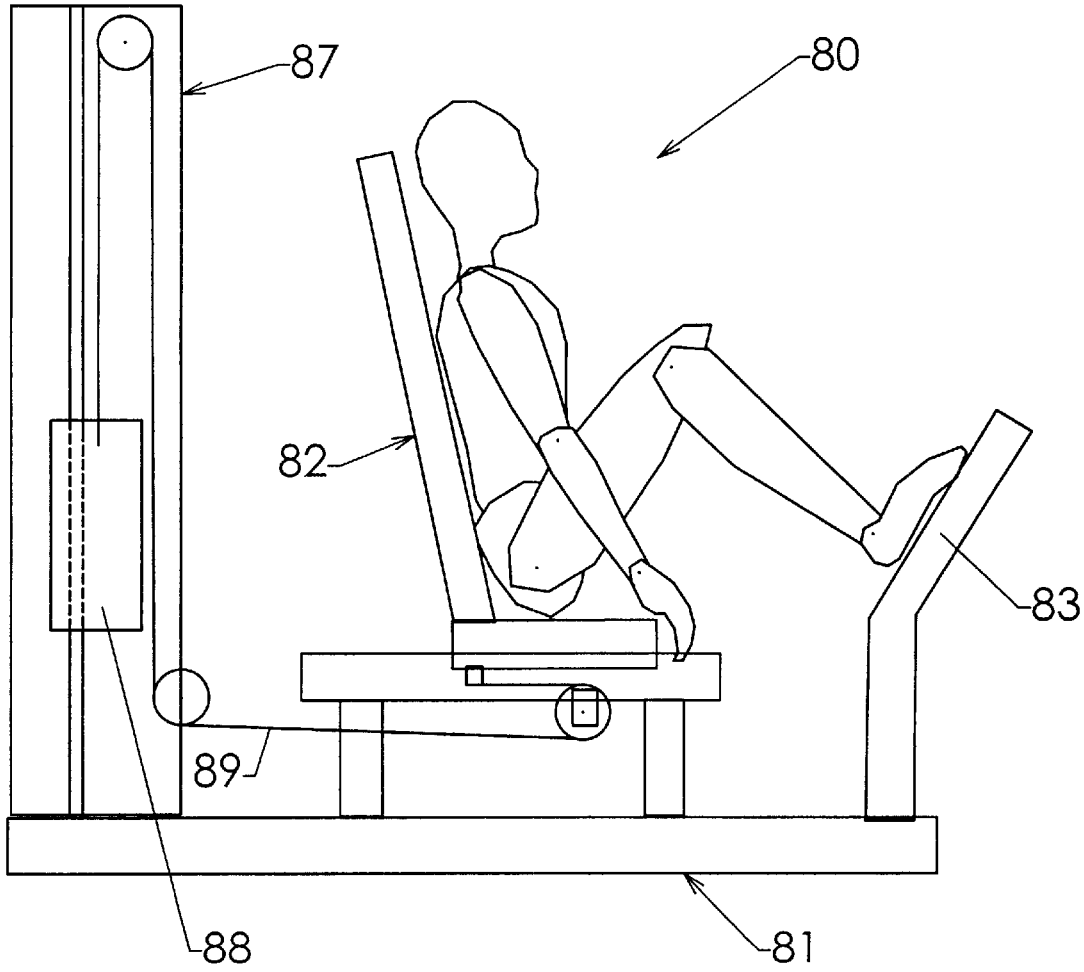
Fig. 8 (prior art)
Figure 9:
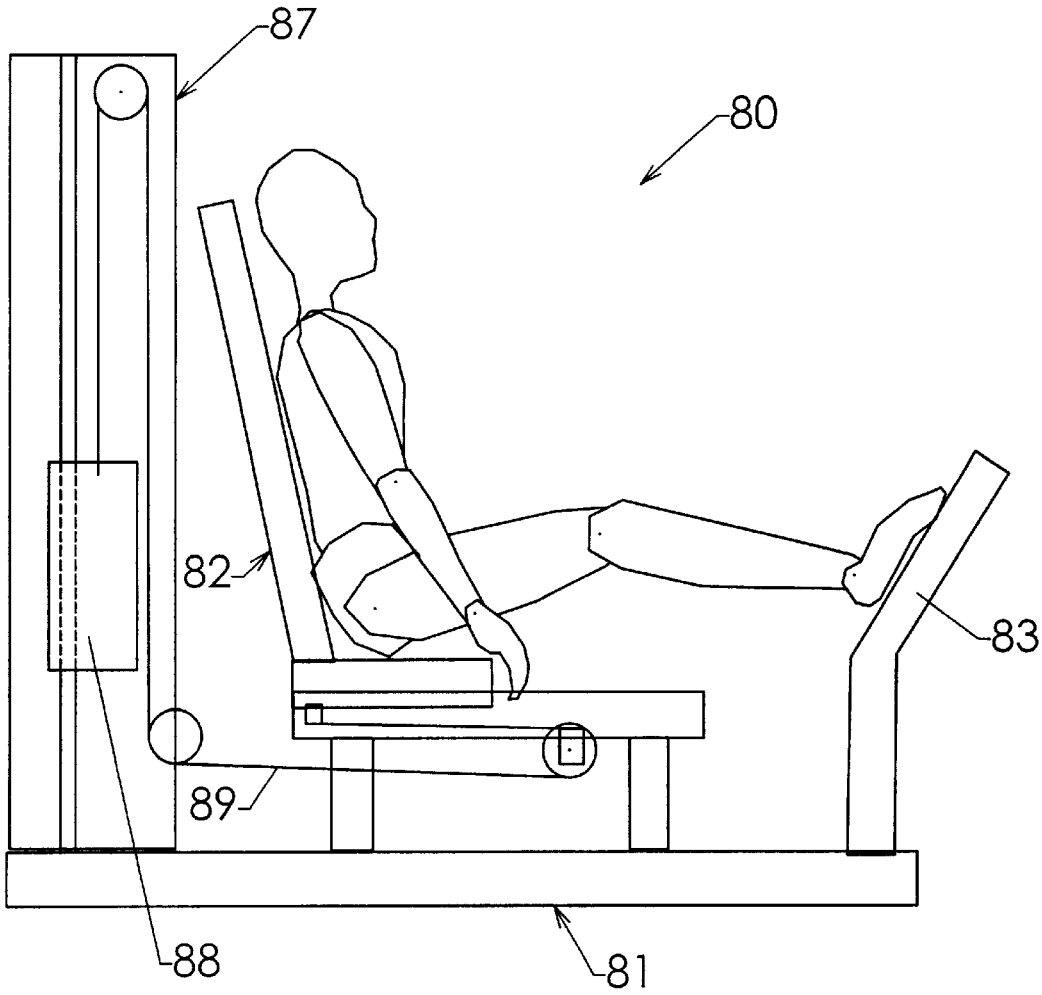
Fig. 9 (prior art)

FIG. 5*a* is an enlarged and fragmented side view of an optional arrangement (not shown on the exercise machine of FIG. 1) for latching the seat relative to the frame and/or limiting forward pivoting of the seat relative to the frame, showing the seat latched to the frame;

FIG. 5*b* is an enlarged and fragmented side view of the optional arrangement of FIG. 5*a*, showing a limit imposed on forward pivoting of the seat;

FIG. 6 is a side view of a prior art leg extension machine, showing a user in a start position;

FIG. 7 is a side view of the prior art leg extension machine of FIG. 6, showing the user's legs in an extended position;

FIG. 8 is a side view of a prior art leg press machine, showing a user in a start position; and FIG. 9 is a side view of the prior art leg press machine of FIG. 8, showing the user's legs in an extended position.

DETAILED DESCRIPTION OF A PREFERRED EMBODIMENT

Figure 1:
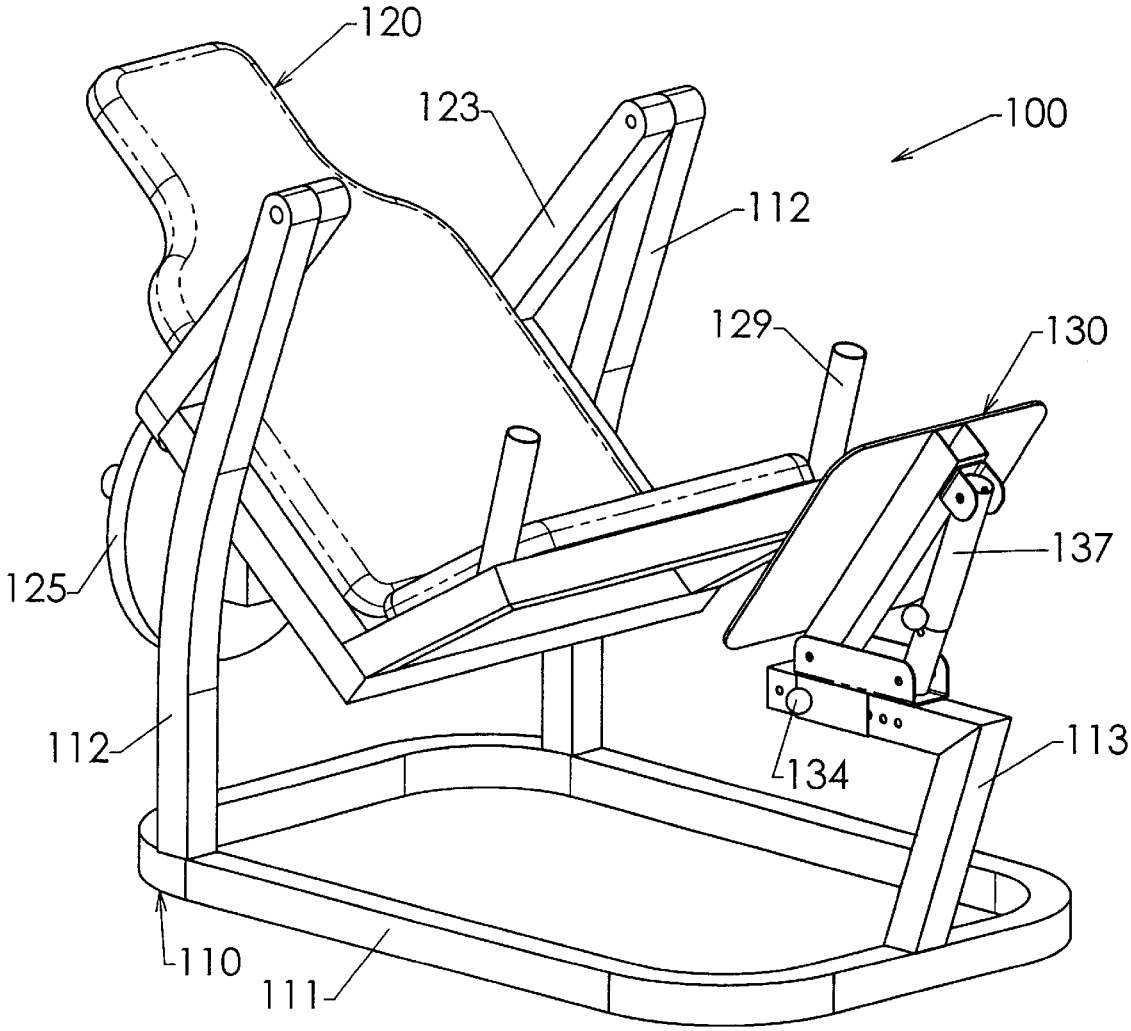
Figure 2:
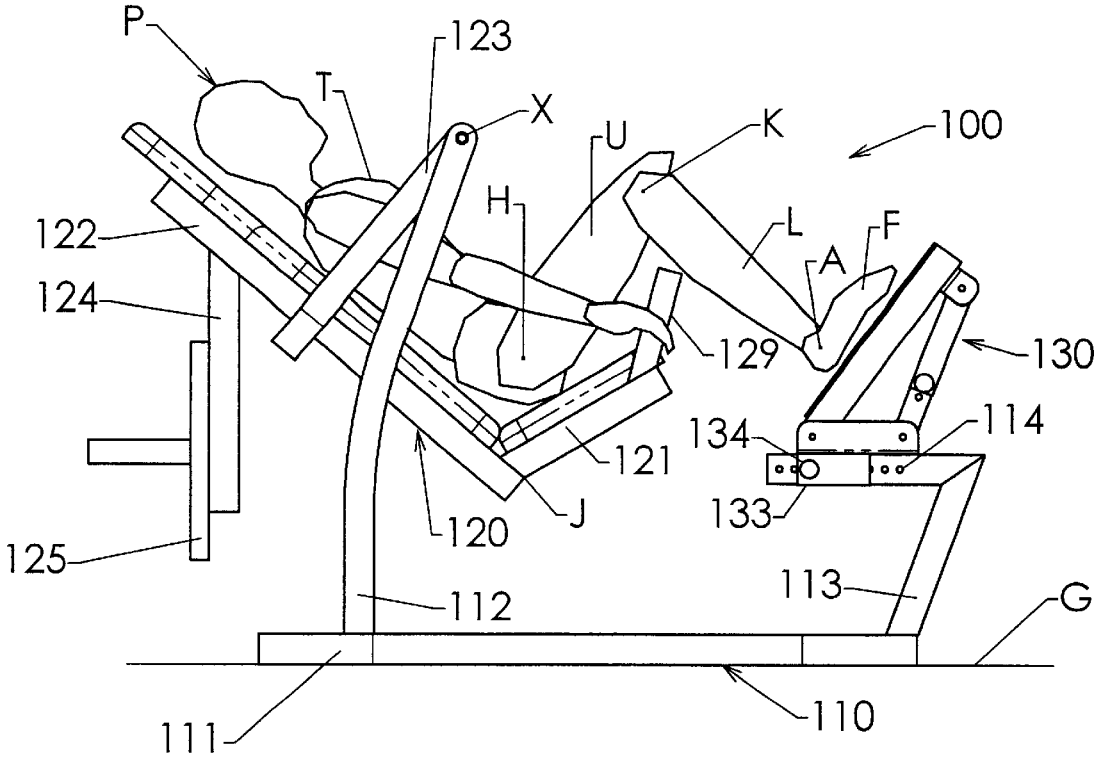
FIG. 2 is a side view of the exercise machine of FIG. 1, showing a user in a start position.
Figure 3:
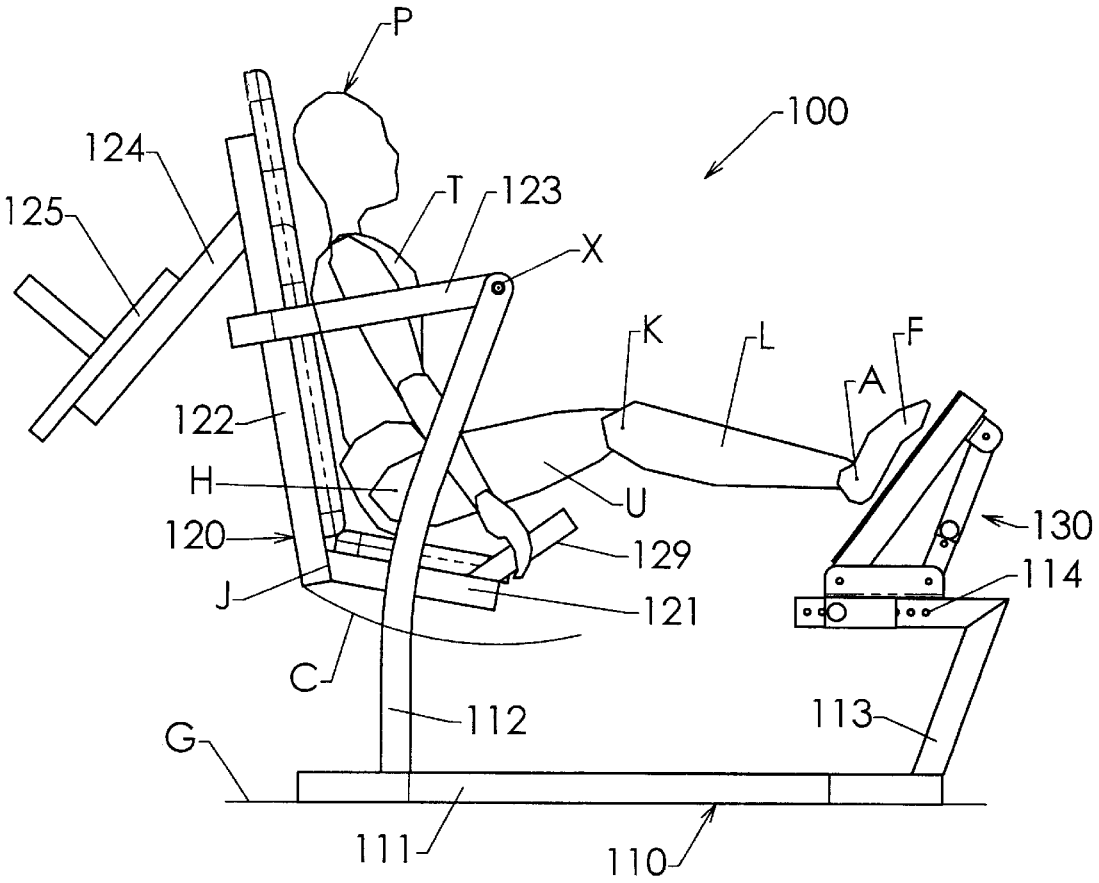
FIG. 3 is a side view of the exercise machine of FIG. 1, showing the user's legs in an extended position.

A preferred embodiment exercise apparatus constructed according to the principles of the present invention is designated as 100 in FIGS. 1–3. The exercise apparatus 100 generally includes a frame 110, a body support 120 mounted on the frame 110, and a foot platform 130 mounted on the frame 110.

The frame 110 includes a base 111 designed to rest on the ground or a floor surface G. The base 111 may be described in terms of a front end, a rear end, and opposite sides. Rubber pads or feet may be secured to the bottom of the base 111 to encourage the apparatus 100 to remain in a stationary position relative to the floor surface G, and/or reduce the likelihood of damage to the floor surface G. The frame 110 also includes left and right stanchions 112 that extend vertically upward from opposite sides of the base 111, and a forward stanchion 113 that extends upward from the forward, transversely extending portion of the base 111.

The body support 120 preferably includes both a seat 121 and a back rest 122, which are rigidly secured to one another (in the region designated as J), and which define an angle of approximately one hundred and ten degrees therebetween. In this regard, the seat 121 and the back rest 122 may be described as approximately perpendicular to one another, with the understanding that approximately is being used in this context to allow for a variance of twenty degrees more or less. Left and right pivot arms 123, which may be opposite distal ends of a single U-shaped member, are rigidly secured to the back rest 122 and extend forward from respective sides thereof. Forward distal ends of the pivot arms 123 are pivotally connected to upper distal ends of respective stanchions 112, thereby defining a common pivot axis X. In other words, the body support 120 is disposed between the stanchions 112 and pivotally mounted on the frame 110 at the pivot axis X. Left and right handlebars 129, which may be opposite ends of a single U-shaped member, are rigidly secured to the body support 120, within reach of a person P resting on the body support 120.

A bracket 124 is rigidly secured to the rear side of the back rest 122 and extends downward and rearward from the back rest 122. One or more weight plates 125 may be selectively mounted on the bracket 124 by means known in the art. In this regard, those skilled in the art will recognize that the depicted embodiment 100 may be described as a "plate loaded" type of exercise machine. Those skilled in the art will also recognize that the present invention may be implemented with other types of known resistance means. For example, in place of the bracket 124 and weight plate 125, a cable could extend from the back rest 122 (proximate the fixed end of the pivot arms 123) downward and about a pulley and then upward and about a pulley on a weight stack unit (similar to the one shown in FIGS. 6–7, for example). Other suitable resistance arrangements might include frictional resistance, fluid resistance, resilient force resistance, and/or electromechanical resistance, all of which are well known in the art and may be adapted for use with the subject invention.

The foot platform 130 may be described as a planar member or plate (or two adjacent co-planar members) having a lower end connected to the stanchion 113, and an upper distal end. The foot platform 130 is preferably adjustable fore and aft relative to the frame 110 (and the body support 120). For example, the stanchion 113 is shown with a horizontal distal portion that is provided with laterally extending holes 114. A sleeve 133 is rigidly mounted on the lower end of the foot platform 130, and is slidably mounted on the horizontal distal portion of the stanchion 113. A spring biased "pop pin" 134 or other suitable fastener is inserted through a hole in the sleeve 133 and any of several alignable holes 114 in the stanchion 113 to secure the foot platform 130 in any of several available locations along the frame 110.

Figure 4:
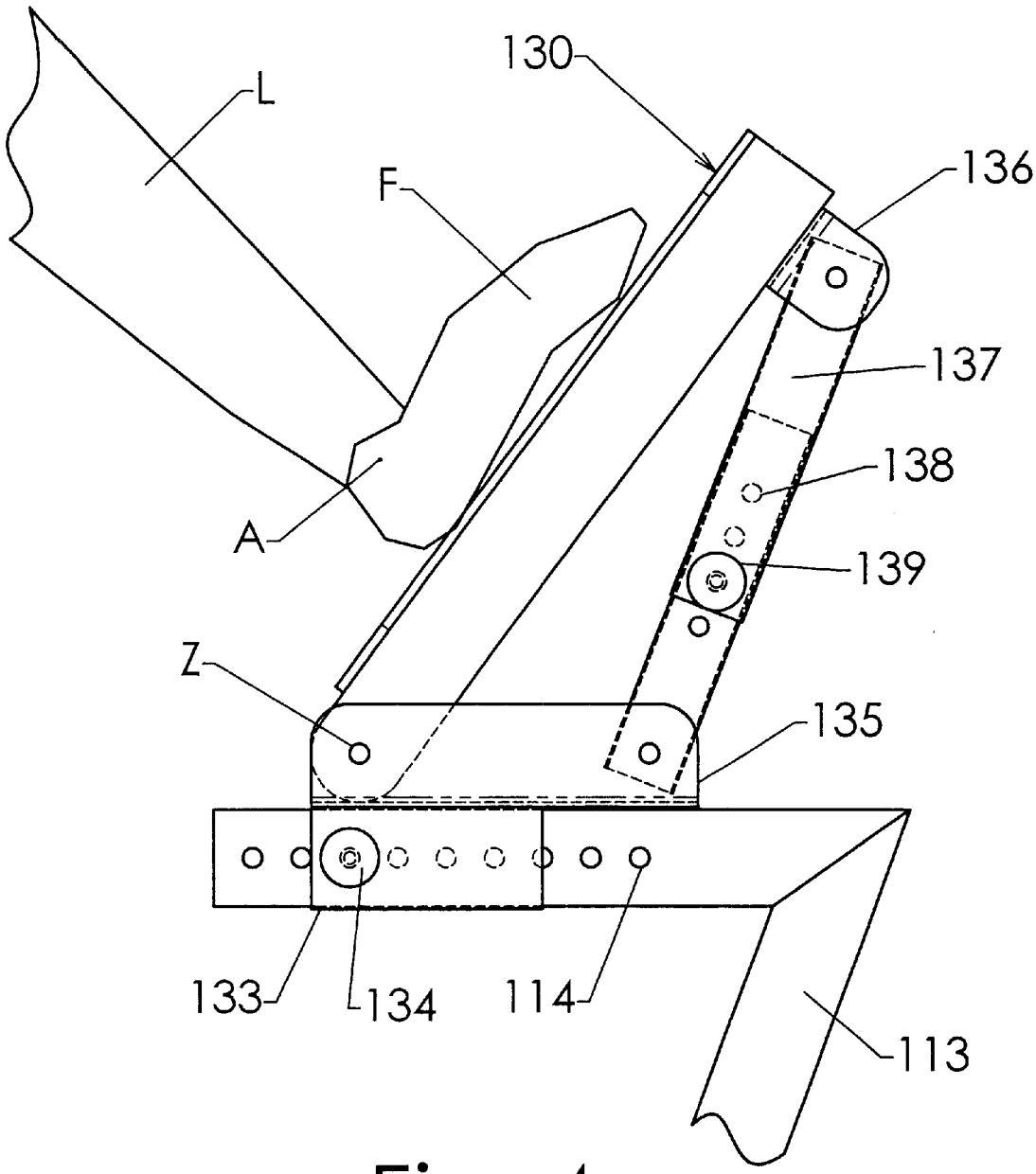
FIG. 4 is an enlarged and fragmented side view of an optional foot platform adjustment arrangement (shown on the exercise machine of FIG. 1)

The orientation of the foot platform 130 relative to the frame 110 is also preferably adjustable. As shown in relatively greater detail in FIG. 4, a lower trunnion 135 is mounted on the sleeve 133, and an upper trunnion 136 is mounted on the upper end of the foot platform 130, on a side opposite the person's feet F. The lower end of the foot platform 130 is pivotally connected to the lower trunnion 135 for selective pivoting about a pivot axis Z. An adjustable length, telescoping member 137 is pivotally interconnected between the trunnions 135 and 136. A spring-biased "pop pin" 139 or other suitable fastener is inserted through a hole in the cylindrical portion of the telescoping member 137 and any of several alignable holes 138 in the rod portion of the telescoping member 137 to secure the foot platform 130 in any of several possible orientations relative to the frame 110. Those skilled in the art will recognize that other adjustment arrangements (e.g., an axially extending hole in the foot platform that aligns with any of several circumferentially spaced holes provided in an adjacent bracket at a common radius from the pivot axis Z), and/or other actuation arrangements (e.g., a lead screw or a linear actuator) may be used to adjust the orientation and/or location of the foot platform 130.

Another option is to provide a foot platform that pivots during exercise activity. To the extent that it may be freely pivoting, any such platform is preferably configured and arranged so that the associated foot engaging surface faces toward the associated pivot axis, thereby encouraging a self-centering effect. Yet another option is to provide a linkage between a pivotal foot platform and a pivotal body support in a manner that favorably links pivoting of same. In either case, a pivotal foot platform may be desired to maintain a comfortable angle between the person's feet and lower legs and/or to accommodate at least some of the lower leg motion associated with the exercise activity.

The apparatus 100 is shown and described with reference to the figure of a person P, who is intended to be representative of a well-proportioned, six foot tall man. The person P and the machine 100 are drawn to scale to facilitate understanding of the machine's dimensions and the geometric relationships between man P and machine 100. In order to accommodate a range of user needs and/or sizes, the machine 100 may be adjusted as discussed above and/or in additional ways (e.g., changing the pivot radius of the body support 120).

FIG. 2 shows the person P occupying a start or rest position on the body support 120, with the back rest 122 facing forward and away from the floor surface G at an angle of fifty degrees from horizontal, and the foot platform 130 facing rearward and away from the floor surface G at an angle of forty degrees from horizontal. In this regard, the back rest 122 may be described as approximately perpendicular to the foot platform 130, where approximately is intended to allow for a variance of twenty degrees more or less, and/or as generally perpendicular to the foot platform 130, where generally is intended to allow for a variance of forty degrees more or less (meaning closer to perpendicular than to parallel). Those skilled in the art will recognize that other embodiments of the present invention may be implemented with different linkage arrangements that may involve different spatial relationships between the components thereof.

A stop may be mounted on the frame 110 to prevent forward pivoting of the body support 120 beyond the position shown in FIG. 2, and/or a latch may be mounted on the frame 110 to selectively latch the body support 120 in the position shown in FIG. 2. Relatively simple examples of each type of arrangement are shown in FIGS. 5*a*–5*b*, with the understanding that other suitable arrangements may be used in the alternative. As shown in FIG. 5*a*, the latching arrangement is implemented by inserting a bolt 119 or other suitable fastener through a hole 127 in a bracket 126 on the modified right pivot arm 123', and through an aligned hole 117 in the modified right stanchion 112'. As shown in FIG. 5*b*, the stopping arrangement is implemented by inserting the bolt 119 through a relatively higher hole 118 in the modified stanchion 112' and into the path of the right pivot arm 123' at a point in front of the right pivot arm 123'.

With reference back to FIG. 2, the person P is shown resting on the body support 120 and grasping the handlebars 129 in his respective hands. The person's torso T and head are aligned with and supported by the back rest 122, and his upper legs U are extending approximately perpendicular to his torso T. The person's hips H are preferably about eighteen inches from the pivot axis X, though this particular embodiment 100 is effective with a range of radial distances between X and H. The person's legs are bent at the knees K so that his lower legs L and his upper legs U cooperate to define an angle of approximately ninety degrees therebetween. The person's feet F are disposed forward of the seat 121, and the soles of his feet F are pressed against the foot platform 130 (thereby establishing a closed chain). The person's ankles A are relaxed, and the person's feet F are extending approximately perpendicular to the person's lower legs L.

For ease of reference, operational characteristics of the apparatus 100 may be described with reference to line segments extending from the person's hip joints H to his knee joints K (HK), and from the person's knee joints K to his ankle joints A (KA), and from the person's ankle joints A to his hip joints H (AH). The HK distance is a fixed distance of about eighteen inches, and the AK distance is a fixed distance of about nineteen and one-half inches. The AK distance is approximately twenty-four inches in FIG. 2, and is approximately thirty-six and one-half inches in FIG. 3.

FIG. 3 shows the person P with his legs relatively straight at the knees K, and the body support 120 having pivoted rearward about the pivot axis X. In this extended position, the person's upper legs U and lower legs L cooperate to define an angle of approximately one hundred and seventy degrees therebetween, which corresponds to an eighty degree change in the angle defined by the person's knees K. In order to reach the position shown in FIG. 3, the body support 120 has pivoted through an angle of approximately forty degrees, which is one-half the change in angle experienced by the person's knees K. The length of the arcuate path traveled by the person's hips H is equal to (2*Π*18) *(40/360) or about twelve and one-half inches (the difference between AK in FIG. 3 and AK in FIG. 2.

The transition between the positions shown in FIGS. 2 and 3 may also be described in terms of both the body support 120 and the person's upper legs U pivoting forty degrees clockwise relative to the frame 110, and the person's lower legs L pivoting forty degrees counter-clockwise relative to the frame. Throughout the range of exercise motion, the person's upper legs U remain orthogonal to the back rest 122 (as on the prior art leg extension machine 90 shown in FIGS. 6–7). As a result, the force contribution from the person's gluteus muscles is essentially minimized, and the force contribution from the person's quadriceps muscles is essentially maximized. Also, the exercise motion involves a chain of body parts that is compressed between the back rest 122 and the foot platform 130 (as on the prior art leg press machine 80 shown in FIGS. 8–9). In other words, the apparatus 100 targets or focuses on the same muscles or exercise activity as a leg extension machine, but engages the user in a manner similar to a leg press machine, thereby facilitating isolated, closed chain exercise of the person's quadriceps muscles.

The present invention has been described with reference to a preferred embodiment, but this disclosure will enable persons skilled in the art to derive additional embodiments and/or variations of the present invention. Recognizing that the present invention may be implemented in various ways, the scope of the present invention is to be limited only to the extent of the following claims.

What is claimed is:

1. A closed chain quadriceps exercise apparatus, comprising:

a frame configured to rest upon a floor surface;

a back rest mounted on the frame;

a foot platform mounted on the frame in front of the back rest, wherein the back rest and the foot platform are configured and arranged to support a person in a rest position with his back against the back rest, his thighs extending perpendicular to his torso, his knees bent, and his feet flat on the foot platform, and at least one of the back rest and the foot platform is movably mounted on the frame in a manner that maintains an orthogonal angle between the person's thighs and torso as the person straightens his legs at the knees while pressing his feet against the foot platform; and a resistance means for resisting straightening of the person's legs at the knees by resisting an accompanying increase in an angle defined between a line extending normal to a back engaging surface on the back rest and a line extending normal to a foot engaging surface on the foot platform.

2. The A closed chain quadriceps exercise apparatus, comprising:

a frame configured to rest upon a floor surface;

a back rest mounted on the frame;

a foot platform mounted on the frame in front of the back rest, wherein the back rest and the foot platform are configured and arranged to support a person in a rest position with his back against the back rest, his thighs extending perpendicular to his torso, his knees bent, and his feet flat on the foot platform, and at least one of the back rest and the foot platform is movably mounted on the frame in a manner that maintains an orthogonal angle between the person's thighs and torso as the person straightens his legs at the knees while pressing his feet against the foot platform, wherein the back rest is movably mounted on the frame and rotates one degree relative to the frame for every two degree change in an angle defined by the person's knees; and a resistance means for resisting straightening of the person's legs at the knees by resisting an accompanying increase in an angle defined between a line extending normal to a back engaging surface on the back rest and a line extending normal to a foot engaging surface on the foot platform.

3. The closed chain quadriceps exercise apparatus of claim 1, further comprising an adjusting means for selectively adjusting the foot platform fore and aft relative to the frame.

4. The closed chain quadriceps exercise apparatus of claim 1, further comprising an adjusting means for selectively adjusting an angle defined between the foot platform and the frame.

5. The closed chain quadriceps exercise apparatus of claim 1, wherein a back engaging surface on the back rest extends generally perpendicular to a foot engaging surface on the foot platform in the rest position.

6. A closed chain quadriceps exercise apparatus, comprising:

a frame configured to rest upon a floor surface;

a back rest mounted on the frame;

a foot platform mounted on the frame in front of the back rest, wherein the back rest and the foot platform are configured and arranged to support a person in a rest position with his back against the back rest, his thighs extending perpendicular to his torso, his knees bent, and his feet flat on the foot platform, and at least one of the back rest and the foot platform is movably mounted on the frame in a manner that maintains an orthogonal angle between the person's thighs and torso as the person straightens his legs at the knees while pressing his feet against the foot platform, wherein the back rest is mounted on the frame for rotation through a range of at least thirty degrees relative to the frame in response to a change in distance of twelve inches between a user's hips and ankles; and a resistance means for resisting straightening of the person's legs at the knees by resisting an accompanying increase in an angle defined between a line extending normal to a back engaging surface on the back rest and a line extending normal to a foot engaging surface on the foot platform.

7. The closed chain quadriceps exercise apparatus of claim 1, wherein when the person occupies the rest position, the back rest faces upward and forward at an angle of approximately fifty degrees relative to the floor surface, and the foot platform faces upward and rearward at an angle of approximately forty degrees relative to the floor surface.

8. A closed chain quadriceps exercise apparatus, comprising:

a frame configured to rest upon a floor surface;

a back rest mounted on the frame for rotation about an axis;

a foot platform mounted on the frame in front of the back rest, wherein the back rest and the foot platform are configured and arranged to support a person in a rest position with his back against the back rest, his thighs extending perpendicular to his torso, his knees bent, and his feet flat on the foot platform, and at least one of the back rest and the foot platform is movably mounted on the frame in a manner that maintains an orthogonal angle between the person's thighs and torso as the person straightens his legs at the knees while pressing his feet against the foot platform; and a resistance means for resisting straightening of the person's legs at the knees by resisting an accompanying increase in an angle defined between a line extending normal to a back engaging surface on the back rest and a line extending normal to a foot engaging surface on the foot platform.

9. The closed chain quadriceps exercise apparatus of claim 8, wherein the back rest and the foot platform cooperate to support the person with his hips at a pivot radius of between twelve and twenty-four inches from the axis.

10. The closed chain quadriceps exercise apparatus of claim 9, wherein the pivot radius is eighteen inches.

11. The closed chain quadriceps exercise apparatus of claim 10, wherein the back rest rotates through a range of forty degrees to accommodate a change in distance of twelve inches between a user's hips and ankles.

12. The closed chain quadriceps exercise apparatus of claim 8, further comprising a locking means for selectively locking the back rest relative to the frame.

13. The closed chain quadriceps exercise apparatus of claim 8, further comprising a limiting means for selectively limiting the back rest to a desired extent of rotation relative to the frame.

14. The closed chain quadriceps exercise apparatus of claim 1, wherein a seat is rigidly secured to a lower end of the back rest.

15. The closed chain quadriceps exercise apparatus of claim 14, further comprising left and right handles rigidly secured to opposite sides of the seat.

16. A closed chain quadriceps exercise apparatus, comprising:

a frame configured to rest upon a floor surface;

a back rest mounted on the frame;

a foot platform mounted on the frame in front of the back rest, wherein the back rest and the foot platform are configured and arranged to support a person in a rest position with his back against the back rest, his thighs extending perpendicular to his torso, his knees bent, and his feet flat on the foot platform, and at least one of the back rest and the foot platform is movably mounted on the frame in a manner that maintains an orthogonal angle between the person's thighs and torso as the person straightens his legs at the knees while pressing his feet against the foot platform; and a resistance means for resisting straightening of the person's legs at the knees by resisting an accompanying increase in an angle defined between a line extending normal to a back engaging surface on the back rest and a line extending normal to a foot engaging surface on the foot platform, wherein the resistance means includes a weight plate selectively mounted on the back rest.

17. A closed chain quadriceps exercise apparatus, comprising:

a frame configured to rest upon a floor surface;

a back rest mounted on the frame;

a foot platform mounted on the frame in front of the back rest, wherein the back rest and the foot platform are configured and arranged to support a person in a rest position with his back against the back rest, his thighs extending perpendicular to his torso, his knees bent, and his feet flat on the foot platform, and at least one of the back rest and the foot platform is movably mounted on the frame in a manner that maintains an orthogonal angle between the person's thighs and torso as the person straightens his legs at the knees while pressing his feet against the foot platform, wherein the back rest and the foot platform cooperate to maintain a person's legs in a closed chain therebetween, and the back rest is mounted on the frame for rotation in response to straightening of the person's legs at the knees; and a resistance means for resisting straightening of the person's legs at the knees by resisting an accompanying increase in an angle defined between a line extending normal to a back engaging surface on the back rest and a line extending normal to a foot engaging surface on the foot platform.

* * * * *